US005969350A

United States Patent [19]

Kerley et al.

[11] Patent Number: 5,969,350

[45] Date of Patent: Oct. 19, 1999

[54] MALDI/LDI TIME-OF-FLIGHT MASS SPECTROMETER

[75] Inventors: Eric L. Kerley, Johnson City; Robert E. Haufler, Oak Ridge; John A. D. Stockdale, Knoxville, all of Tenn.

[73] Assignee: Comstock, Inc., Oak Ridge, Tenn.

[21] Appl. No.: 09/040,159

[22] Filed: Mar. 17, 1998

[51] Int. Cl.[6] ..... H01J 48/40

[52] U.S. Cl. ..... 250/287

[58] Field of Search ..... 250/287

[56] References Cited

U.S. PATENT DOCUMENTS

| | | | |
|---|---|---|---|
| 3,727,047 | 4/1973 | Janes . | |
| 4,731,532 | 3/1988 | Frey et al. . | |
| 5,032,722 | 7/1991 | Boesl et al. . | |
| 5,117,107 | 5/1992 | Guilhaus et al. . | |
| 5,160,840 | 11/1992 | Vestal | 250/287 |
| 5,504,326 | 4/1996 | Reilly et al. . | |
| 5,510,613 | 4/1996 | Reilly et al. . | |
| 5,580,434 | 12/1996 | Robotti et al. . | |
| 5,595,636 | 1/1997 | Franzen . | |
| 5,627,369 | 5/1997 | Vestal et al. . | |
| 5,641,959 | 6/1997 | Holle et al. . | |
| 5,654,545 | 8/1997 | Holle et al. . | |
| 5,696,376 | 12/1997 | Doroshenko et al. . | |
| 5,705,813 | 1/1998 | Apffel et al. . | |
| 5,712,479 | 1/1998 | Reilly et al. . | |
| 5,716,825 | 2/1998 | Hancock et al. . | |

FOREIGN PATENT DOCUMENTS 3428944 2/1985 Germany .

OTHER PUBLICATIONS

Pierce, J.R. *Theory and Design of Electron Beams*, 2nd Edition, Van Nostrand, New York (1954).

Sanzone, G. Energy Resolution of the Conventional Tome–of–Flight Mass Spectrometer, *The Review of Scientific Instruments*, vol. 41, No. 5, 741–2 (May, 1970).

deHeer, W.A., P. Milani, Large Ion Volume Time–of–Flight Mass Spectrometer with Position– and Velocity–Sensitive Detection Capabilities for Cluster Beams, Rev. Sci. Instrum., vol. 62, No. 3, 670–7 (Mar. 1991).

Sinha, Mahadeva P., Development of a Miniaturized Gas Chromatograph–Mass Spectrometer with a Microbe Capillary Column and an Array Detector, Anal. Chem. vol. 63, No. 18, Sep. 15, 1991, pp. 2012–2016.

Meuzelaar, Henk L.C., *Man–Portable GC/MS; Opportunities, Challenges, and Future Directions*, Center for Micro Analysis & Reaction Chemistry, University of Utah, Salt Lake City, UT 84112.

Guilhaus, M. S Spontaneous and Deflected Drift–Trajectories in Orthogonal Acceleration Time–of–Flight Mass Spectrometry, J. Am. Soc. Mass Spectrom 1994, vol. 5, pp. 588–595.

*Primary Examiner*—Kiet T. Nguyen
*Attorney, Agent, or Firm*—Pitts & Brittian, P.C.

[57] ABSTRACT

A matrix-assisted laser desorption ionization/laser desorption ionization (MALDI/LDI) time-of-flight mass spectrometer (TOF-MS) which includes an ion source employing a ground voltage configuration. The improved MALDI/LDI TOF-MS includes a laser for ablating a sample positioned within a gridless source. The ionized sample is then repelled through a floating flight tube toward a detector and within a vacuum chamber. The floating flight tube allows a lower than conventional voltage to be applied to the ions. A digital camera is provided for viewing a sample when positioned in the vacuum ready for analysis. The sample image is displayed on the control computer monitor and is available for computer analysis and instrumentation control, including external instrumentation such as that involved in sample preparation and handling. A sample plate and sample changer are referenced at ground voltage, thus allowing the sample plate to define a relatively large configuration, such as one defining a microtiter sample receptor matrix of 8×12. A work shelf is provided for use of an operator and is disposed proximate an opening to the sample changer, and, to this extent, defines a sample plate entry. While being convenient to the operator for loading and unloading samples, the configuration of the work shelf and sample changer also facilitates interfacing with robotic sample handling equipment.

16 Claims, 6 Drawing Sheets

MALDI/LDI TIME-OF-FLIGHT MASS SPECTROMETER

TECHNICAL FIELD

This invention relates to the field of mass spectrometry. More specifically, this invention relates to an improved matrix assisted laser desorption ionization/laser desorption ionization (MALDI/LDI) time-of-flight (TOF) mass spectrometer having a ground voltage source configuration, a second-order spatial focusing ion source, and velocity focusing pulse ion extraction. The improved MALDI/LDI TOF mass spectrometer is provided with a sample plate for retaining a plurality of samples to be tested, the sample plate being large enough to employ a standard 8×12 (96 sample) microtiter plate format.

BACKGROUND ART

In the field of mass spectrometry, time-of-flight (TOF) techniques are well known. Typical descriptions of those techniques and principles of electron beam characteristics are discussed in the following references:

Pierce, J. R., *Theory and Design of Electron Beams,* 2nd Edition, Van Nostrand, New York (1954).

Sanzone, G., *Energy Resolution of the Conventional Time-of-Flight Mass Spectrometer, The Review of Scientific Instruments*, Volume 41, Number 5, 741–2 (May, 1970).

de Heer, W. A., P. Milani, *Large Ion Volume Time-of-Flight Mass Spectrometer with Position- and Velocity-Sensitive Detection Capabilities for Cluster Beams, Rev. Sci. Instrum.*, Volume 62, No. 3, 670–7 (March, 1991).

Matrix-assisted laser desorption ionization (MALDI) is a "soft" ionization technique for introducing very large delicate molecules such as proteins into a mass spectrometer without fragmentation. M. Karas and F. Hillenkamp, *Matrix Assisted Laser Desorption Ionization*, Anal. Chem. 60, 2299 (1988) describe the method. Using the MALDI technique, molecular samples to be investigated are laid down on a matrix material which absorbs light at the frequency of a particular pulsed laser. When the pulsed laser is focused on the sample, the energy of each pulse is absorbed largely by the matrix. A plume of matrix fragments and ions carries the sample molecules into the vacuum in a largely undisturbed state. A certain fraction of these become ionized due to charge exchange or absorption of energy from nearby matrix fragments. If this takes place in the ion source region of a mass spectrometer it is possible to measure the masses of the sample ions. The method is particularly suited to time-of-flight mass spectrometry since it is inherently a pulsed method. Numerous researchers have built MALDI/LDI time-of-flight mass spectrometers and approximately ten instrument companies offer such instruments. Unlike the present invention, however, none are specifically designed for automation of MALDI/LDI measurements.

Accordingly, it is an object of the present invention to provide a matrix-assisted laser desorption ionization/laser desorption ionization (MALDI/LDI) time of flight mass spectrometer (TOF-MS) constructed in such a manner as to facilitate automated measurement of samples placed therein on a sample plate.

It is also an object of the present invention to provide such a MALDI/LDI TOF-MS which is provided with a sample changer designed to manipulate a microtiter plate defining a plurality of sample wells disposed in a matrix such as an 8×12 array dimensionally configured according to industry standards for other analytical equipment.

Another object of the present invention is to provide such a mass spectrometer which further includes a sample imaging system capable of storing sample images in computer memory and displaying such images on a computer monitor with mass spectral and other data.

A further object of the present invention is to provide such a mass spectrometer wherein a sample entry system is carried within an illuminated work shelf.

Still yet another object of the present invention is to provide a MALDI/LDI TOF-MS which is provided with control electronics and software for permitting feedback control of the sample changer and the mass spectrometer, as well as any associated external instruments, based on analysis by the instrument computer, of sample images, mass spectra, or other available data generated by the instrument itself or by the external instrumentation.

Further, it is an object of the present invention to provide a MALDI/LDI TOF-MS having an ion source employing a ground voltage configuration.

DISCLOSURE OF THE INVENTION

Other objects and advantages will be accomplished by the present invention which is a matrix-assisted laser desorption ionization/laser desorption ionization (MALDI/LDI) time-of-flight mass spectrometer (TOF-MS) which includes an ion source employing a ground voltage configuration. The improved MALDI/LDI TOF-MS includes a laser for ablating a sample positioned within a gridless source. The ionized sample is then repelled through an electrically floating flight tube toward a detector and within a vacuum chamber. The floating flight tube allows a lower voltage to be applied to the ions and floats at the potential of the entrance of the mass gate electrodes, the ions are directed through a post-accelerator electrode stack and to the electron multiplier, or detector. The lower voltage on the flight tube results in a longer flight time for the ions and gives higher mass resolution in a shorter tube.

A digital camera is provided for viewing a sample under controlled illumination conditions when the sample is positioned in the vacuum ready for analysis. A light is provided for illuminating the sample for viewing by the digital camera, which is aimed at the sample to be tested. The sample image is displayed on the control computer monitor and is available for computer analysis. Software control of the instrument functions may be accomplished based on the sample image. Further, software control of external instruments via signals generated by the control electronics may also be accomplished.

Control electronics are provided for generating digital or analog signals for controlling both the internal functions of the MALDI/LDI TOF-MS and external instruments such as those involved in sample preparation and handling. Thus complete automation of MALDI/LDI measurements under software control is accomplished.

A number of samples to be tested are placed upon a sample plate which is then placed within a sample changer. The sample plate and sample changer are referenced at ground voltage. The flight tube is maintained at a separately adjustable potential relative to ground potential in order to prevent field penetration from the grounded vacuum container from influencing ions during their flight.

Because the sample plate and sample changer are referenced at ground voltage, the sample plate may define a relatively large configuration, such as one defining a sample receptor matrix of 8×12 microtiter plate which measures three inches by four and one-quarter inches (3"×4¼"), thus accommodating loading of ninety-six (96) samples in the sample changer for any given test. Further, the sample plate and the surrounding mechanism are likewise maintained at ground potential. Due to the operation of the ion source of the present invention at ground voltage, operator safety is maximized since the ion source region serves as an operator interface. Further, utility of the MALDI/LDI TOF-MS is enhanced in that power supplies associated with the sample changer, such as the repeller voltages, are referenced to ground, rather than being floated to high voltages.

A work shelf is provided for use of an operator. A light is installed in the instrument case and above the work shelf for illuminating the work shelf. The work shelf is disposed proximate an opening to the sample changer, and, to this extent, defines a sample plate entry. While being convenient to the operator for loading and unloading samples, the configuration of the work shelf and sample changer also facilitates interfacing with robotic sample handling equipment. Such equipment is widely available for the microtiter plate sample format.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
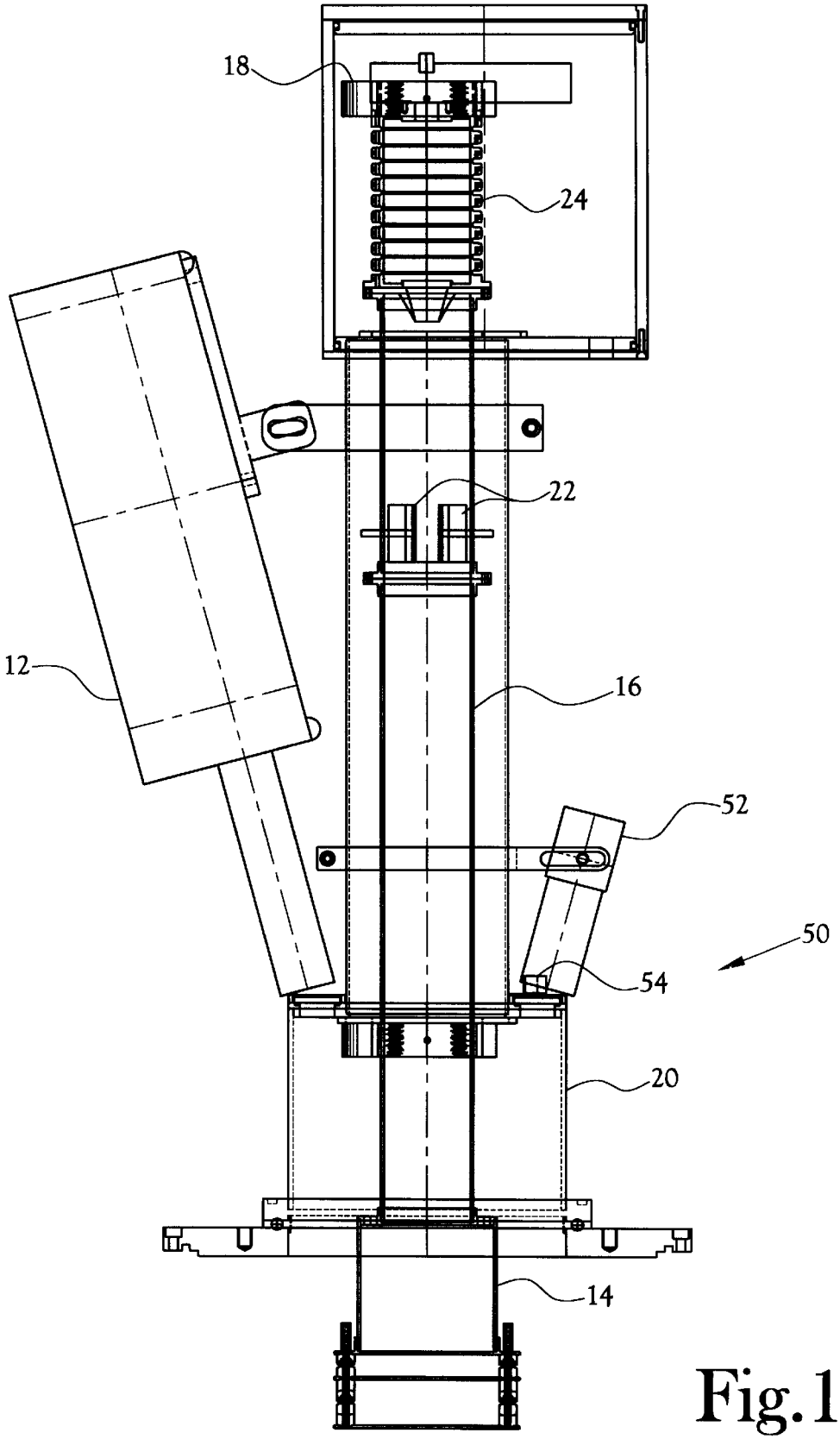
FIG. 1 is a schematic illustration of the Matrix Assisted Laser Desorption Ionization/Laser Desorption Ionization (MALDI/LDI) Time-of-Flight Mass Spectrometer (TOF-MS) constructed in accordance with several features of the present invention and including a floating flight tube.
Figure 2:
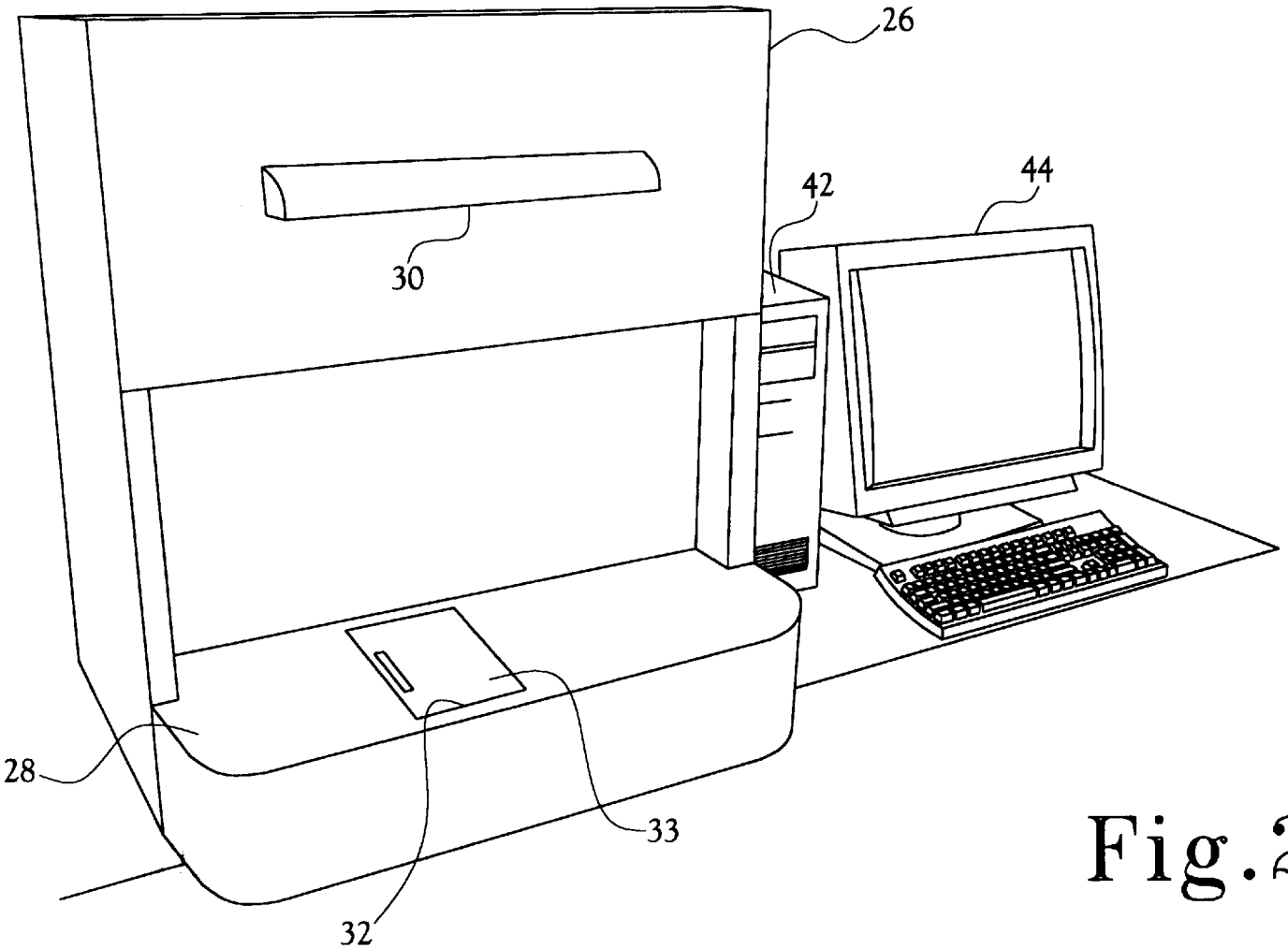
FIG. 2 is a perspective view of the MALDI/LDI TOF-MS of the present invention shown housed within a cabinet having a work shelf, overhead illumination of a sample entry port configured to accept an 8×12 microtiter source plate.
Figure 3:
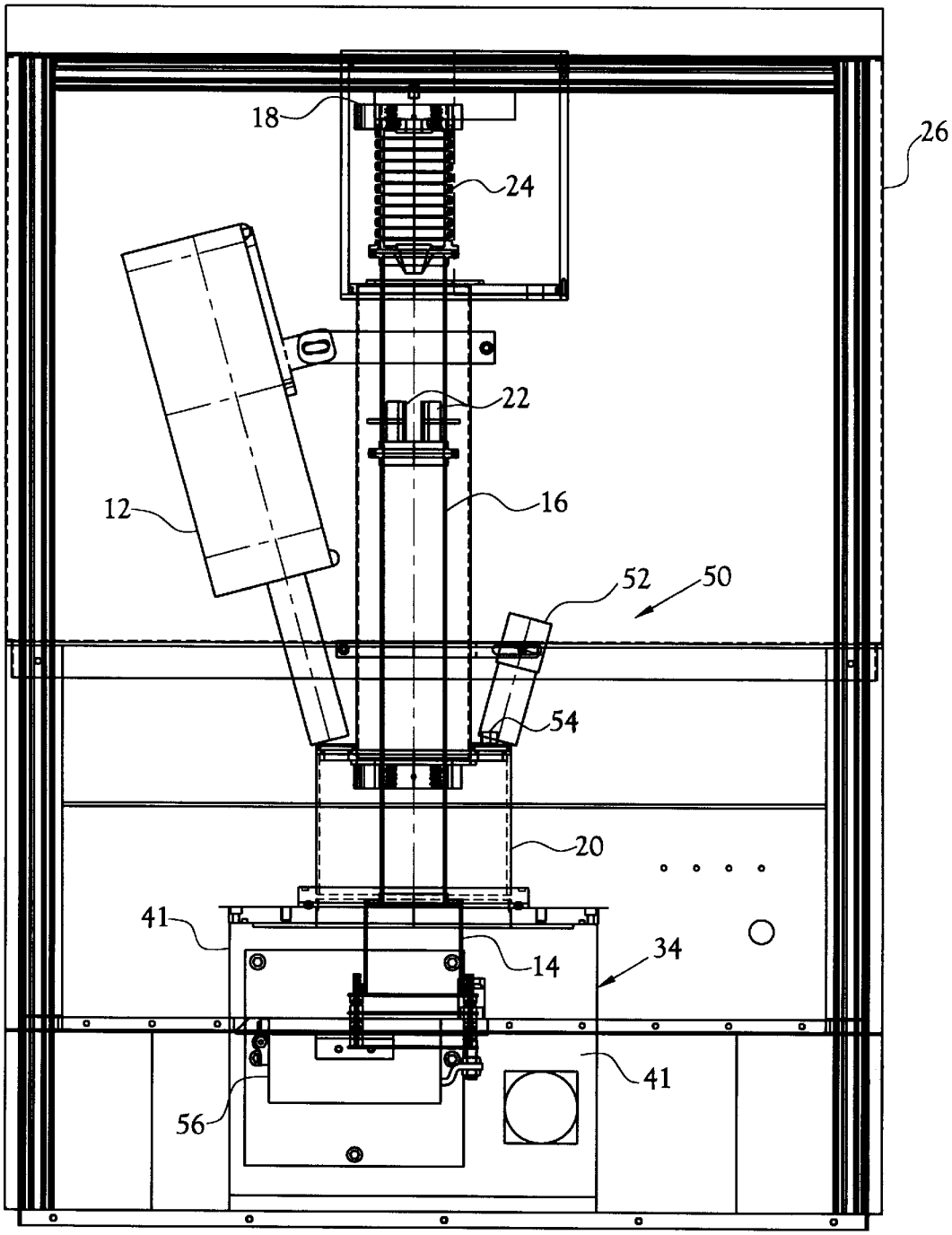
FIG. 3 is a schematic illustration of the MALDI/LDI TOF-MS of the present invention showing the grounded source and sample changer configuration.

An improved matrix-assisted laser desorption ionization/laser desorption ionization (MALDI/LDI) time-of-flight mass spectrometer (TOF-MS) incorporating various features of the present invention is illustrated generally at 10 in the figures. The sample plate 36 which is located below the ion source 14 is at ground voltage. The improved MALDI/LDI TOF-MS 10 includes a sample changer 34 designed to handle microtiter plates 36 having a matrix of sample wells 38 such as in an 8×12 arrangement. A sample imaging system 50 is provided for storing sample images in computer memory and displaying the same on a computer monitor 44 with mass spectral and other data. A sample entry system 32 is built into an illuminated work shelf 28 for use in loading and unloading the sample plate 36. Control electronics and associated software permit feedback control of the sample changer 34, mass spectrometer 10, and any associated external instruments (not shown), based on analysis by the instrument computer 42, of sample images, mass spectra, or other available data generated by the MALDI/LDI TOF-MS 10 or by external instrumentation.

The MALDI/LDI TOF-MS 10, as illustrated schematically in FIG. 1, is similar to conventional MALDI TOF mass spectrometers. A laser 12 is provided for ablating a sample positioned on the sample plate 36 just below the gridless ion source 14. The laser 12 essentially vaporizes the sample off the sample plate 36 and simultaneously ionizes the sample. The ionized sample is then repelled through a flight tube 16 toward a detector 18 and within a vacuum chamber 20. In the present invention, the flight tube 16 is a floating flight tube which allows a lower voltage to be applied to the ions. Because voltage applied to the ions is lower than in conventional devices, the ions travel through the floating flight tube 16 at a slower rate than do ions through a conventional device. As a result, the floating flight tube 16 is more effective than a conventional flight tube by a factor of at least three (3) in the illustrated embodiment. Specifically, in order to obtain a similar resolution from a conventional device, the flight tube must be approximately three times longer than the floating flight tube 16 of the present invention. Conversely, with a conventional device having a flight tube equal in length to the floating flight tube 16 of the present invention, the resolution is approximately three times better in the present invention.

After passing through the floating flight tube 16, which floats at the potential of the entrance of the mass gate electrodes 22, the ions are directed through a post accelerator electrode stack 24 and to the electron multiplier, or detector 18.

A digital camera 52 is provided for viewing a sample under controlled illumination conditions when the sample is positioned in the vacuum ready for analysis. A light 54 is provided for illuminating the sample for viewing by the digital camera 52, which is aimed at the sample to be tested. The sample image is displayed on the control computer monitor 44 and is available for computer analysis. Because the sample image is available for computer analysis, software control of the instrument functions may be accomplished based on the sample image, and/or on the acquired ion time-of-flight or mass data. Further, software control of external instruments via signals generated by the control electronics may also be accomplished.

The present invention is equipped with control electronics for generating digital or analog signals for controlling both the internal functions of the MALDI/LDI TOF-MS 10 and external instruments such as those involved in sample preparation and handling. Thus complete automation of MALDI/LDI measurements under software control is accomplished.

A number of samples to be tested are placed upon a sample plate 36 which is then placed within a sample changer 34. Because the present invention incorporates a floating flight tube 16 as described, the sample plate 36 and sample changer 34 are referenced at ground voltage. The flight tube 16 is maintained at a separately adjustable potential relative to ground potential. Such an arrangement permits operation of the source region where the ions are formed at ground potential.

Because the sample plate 36 and sample changer 34 are referenced at ground voltage, the sample plate 36 may define a relatively large configuration, such as one defining a sample well 38 matrix of 8×12 microtiter plate 36, thus accommodating loading of ninety-six (96) samples in the sample changer 34 for any given test. If the source region were to be floated to high voltage, as in the prior art, accommodation of such a sample plate 36 is not practical in that the components of the sample changer 34 must be at high voltage, thus requiring the entire sample changer 34 and ion source 14 to be insulated from ground and from the operator.

Because the source region is operated at ground potential, the sample plate 36 and the surrounding mechanism is likewise maintained at ground potential. If the sample plate 36 is at high voltage, then either the entire sample changer 34 must be at high voltage in order to prevent fringing fields between the sample plate 36 and the body of the sample changer 34, or the sample plate 36 must be insulated from the body of the sample changer 34. If the sample plate 36 is insulated from the body of the sample changer 34, fringing field effects are likely to be severe. Further, if either or both of the sample plate 36 and sample changer 34 are at high voltage the repeller voltage supply must also be floated at high voltage. Due to the operation of the sample plate 36 of the present invention at ground voltage, operator safety is maximized. Further, utility of the MALDI/LDI TOF-MS 10 is enhanced in that power supplies associated with the sample changer 34, such as the repeller voltages, are referenced to ground, rather than being floated to high voltages.

The use of a large sample plate 36 such as the 96 sample (8×12) microtiter plate format is advantageous in that the sample changer 34 is easily configured to receive any existing MALDI sample plate formats. A great deal of biotechnology instrumentation has been developed which employs the 8×12 microtiter plate format. Included is robotic sample preparation and processing equipment. The availability of such format in the present invention renders the present invention compatible with many other conventional instruments, and enables robotic sample preparation and presentation of samples to the present invention.

A work shelf 28 is provided for use of an operator. To this extent, the work shelf 28 is provided in the front of the MALDI/LDI TOF-MS 10 of the present invention. A light 30 is installed in the instrument case 26 and above the work shelf 28 for illuminating the work shelf 28. The work shelf 28 is disposed proximate an opening 40 to the sample changer 34, and, to this extent, defines a sample plate entry 32. While being convenient to the operator for loading and unloading samples, the configuration of the work shelf 28 and sample changer 34 also facilitates interfacing with robotic sample handling equipment.

The ion source 14 in the present invention employs second-order spatial correction. That is, an algebraic expression is calculated for the total time-of-flight of the ions from the instant they first experience the repeller voltage to the time that they strike the detector surface 18. The first and second derivatives of this expression with respect to the flight axis co-ordinate are then equated to zero, and the positions of the ion source repeller and extraction electrodes derived.

Figure 4:
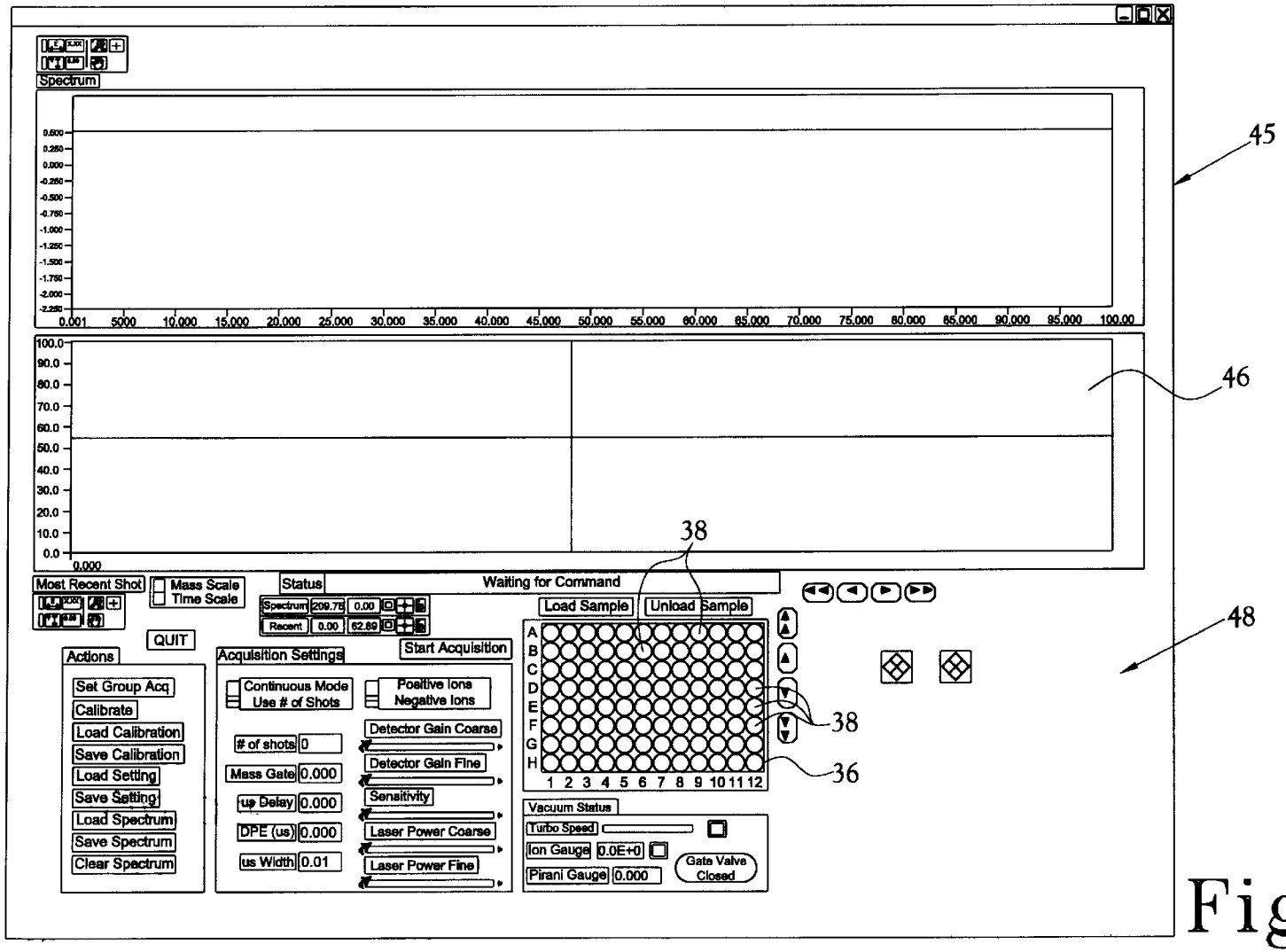
FIG. 4 illustrates an exemplary schematic of a monitor display showing a sample viewing region, and a spectral data region.

In practice, the MALDI/LDI TOF-MS 10 of the present invention is used to analyze a relatively large number of samples as compared to conventional MALDI TOF mass spectrometers. The sample changer 34 of the present invention is configured such that all existing MALDI sample plate formats may be accepted thereby. However, because many other disciplines use microtiter plate formats for chemical and biological analysis, the sample changer 34 is further configured to accept other, typically larger, sample plates, such as the described 8×12, 96 sample, sample plate. Once the sample plate 34 is positioned within the sample changer 34, an operator views the sample image displayed on the computer monitor 44 to ensure that the sample to be analyzed is within the scope of the laser 12. Illustrated in FIG. 4 is an exemplary user interface screen for being displayed on a computer monitor 44. The user interface screen 45 includes a spectroscopy image filed 46 for graphically displaying the spectroscopic data collected. A sample viewing field 48 is also provided for viewing the image being generated by the sample imaging system 50. An image of the microtiter plate 36 as well as various control features are likewise displayed on the user interface screen 45 in order to assist the user of the MALDI/LDI TOF-MS 10 of the present invention.

In the case where the computer 42 is processing the sample image for automated control of the MALDI/LDI TOF-MS 10, manual operator input is not required. When a further sample is to be analyzed, the sample changer 34 manipulates the sample plate through x-y movements until the further sample is aligned with the laser. Upon completion of the analysis of each of the samples, the sample changer 34 is accessed to remove and replace the sample plate 36 for subsequent analysis.

Figure 5:
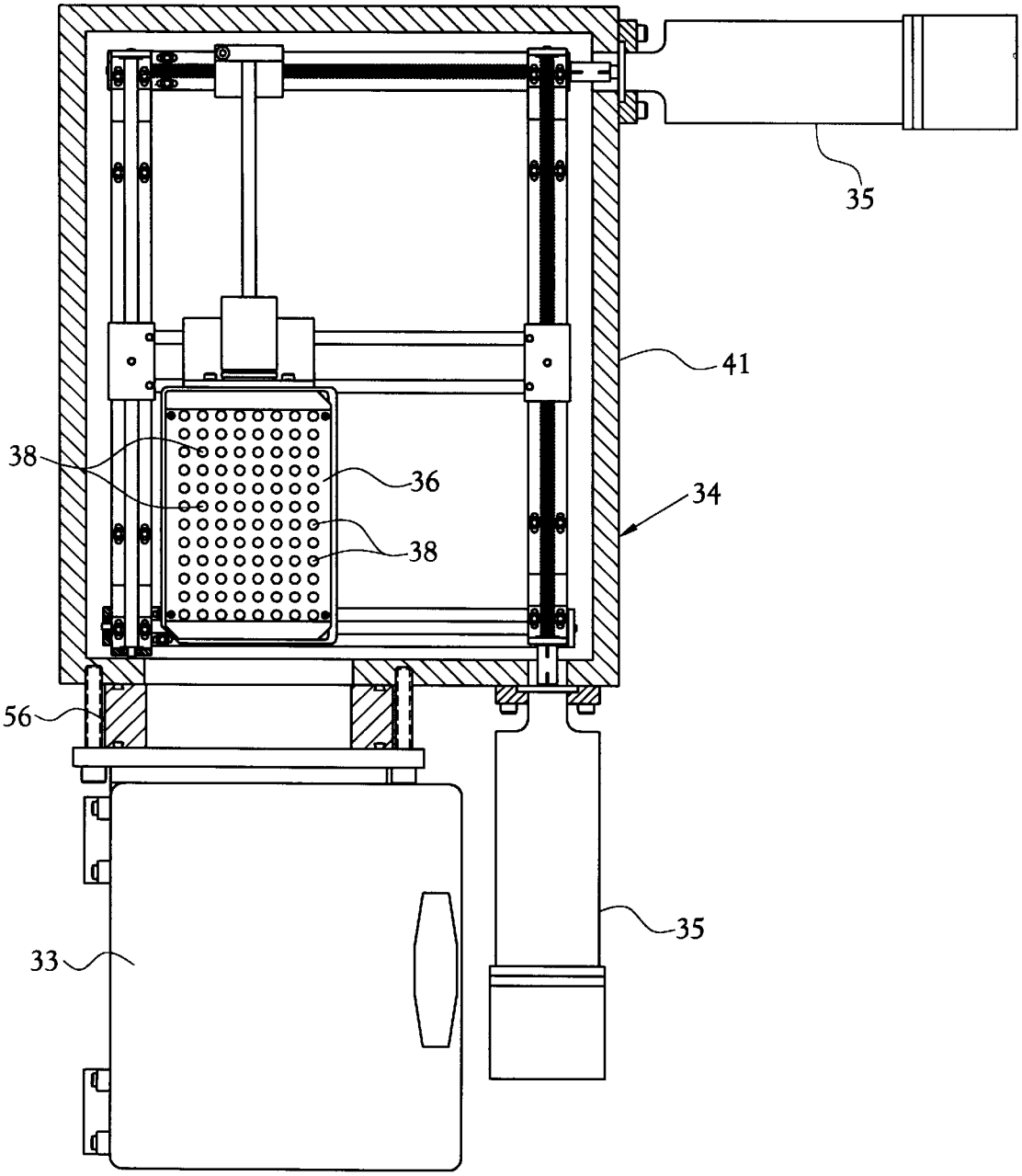
FIG. 5 illustrates a top plan view, in section, of the sample chamber of the present invention.

FIG. 5 illustrates a top plan view of the sample changer 34. From this illustration, it is more clearly seen that the sample plate 36 is received through the access door 33, through the vacuum lock 56 and into the vacuum box 41. The sample plate 36 may then be manipulated in either or both of an x- and y-direction via the drive motors 35 until the selected sample is in view of the digital camera 52 and more importantly, the laser 12.

Because the ionization and analysis of the sample is performed in a vacuum, a vacuum lock 56 is provided to maintain the vacuum within the chamber 20. The vacuum lock 56 is used when the sample plate 36 has been removed from the sample changer vacuum box 41 for removal and replacement. After the sample plate 36 has been positioned in place in the sample plate entry 32, the access door 33 is closed, and a vacuum is created therein. After the pressure within the sample plate entry 32 has been lowered to equal that of the vacuum chamber 20, the vacuum lock 56 is opened and the sample plate 36 is moved into the sample changer 34 for analysis.

Figure 6:
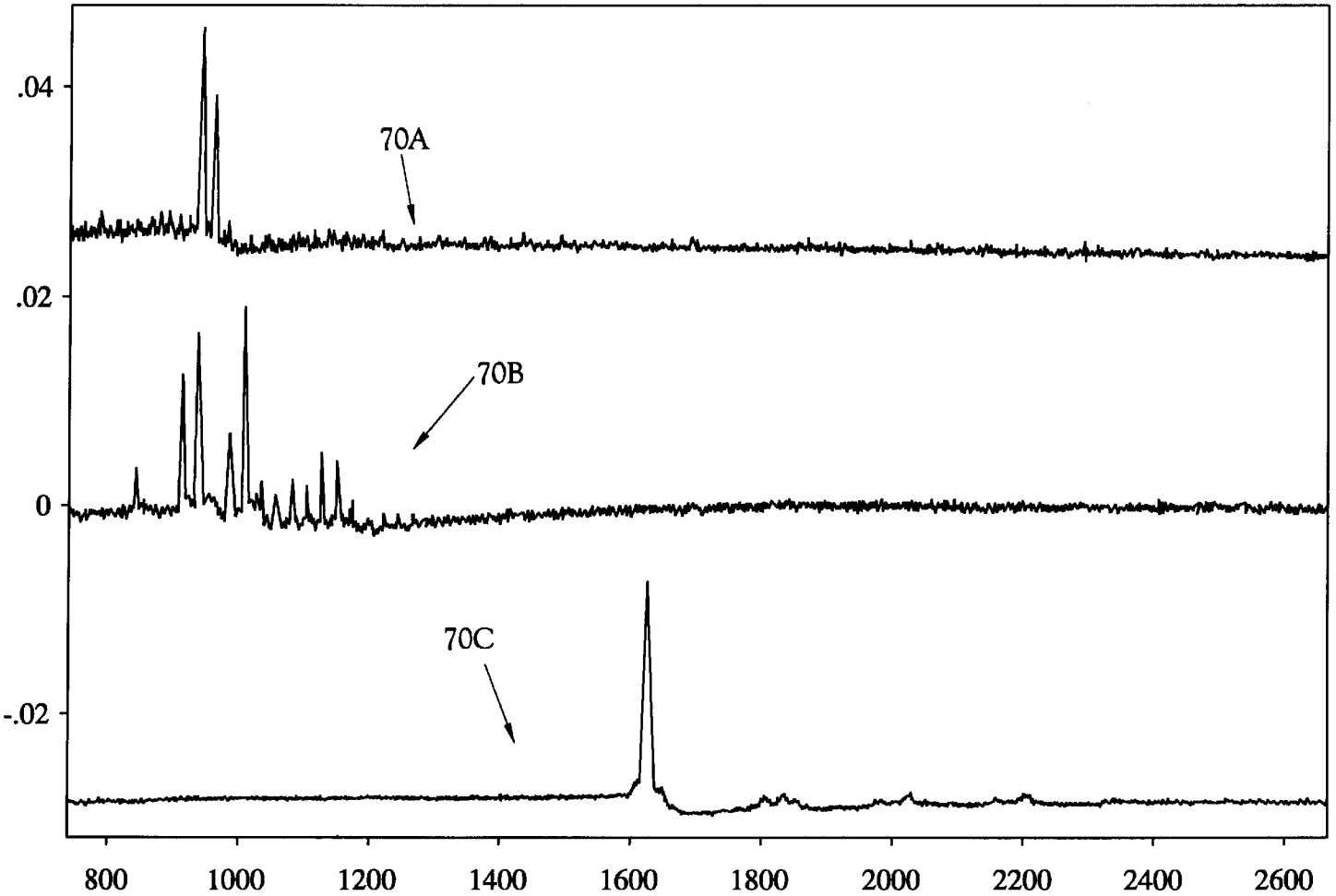
FIG. 6 is a spectrograph of the data collected for three samples tested using the MALDI/LDI TOF-MS of the present invention.

Sample mass spectra obtained using the present invention are illustrated in FIG. 6. These spectra were obtained by nitrogen laser action upon the peptide oxytocin 70A, higher fullerenes 70B, and the peptide somatostacin 70C.

Although specific conditions, dimensions, and other values have been disclosed for one embodiment of the present invention, and for a particular experimentation, it will be understood that such disclosure is not intended to limit the present application to such disclosure.

From the foregoing description, it will be recognized by those skilled in the art that an improved MALDI/LDI TOF-MS offering advantages over the prior art has been provided. Specifically, the improved MALDI/LDI TOF-MS includes an ion source employing a ground voltage configuration, thereby allowing a sample changer and sample plate to be biased at ground voltage. Such configuration is accomplished by the use of a floating flight tube which floats at the potential of the entrance of the mass gate electrodes. The MALDI/LDI TOF-MS includes a sample imaging system capable of storing sample images in computer memory and displaying such images on a computer monitor with mass spectral and other data. Control electronics and software are provided for permitting feedback control of the sample changer and the mass spectrometer, as well as any associated external instruments, based on analysis by the instrument computer, of sample images, mass spectra, or other available data generated by the instrument itself or by the external instrumentation. A sample entry system is carried within an illuminated work shelf and is configured to received microtiter sample plates of up to at least an 8×12 matrix of samples.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A matrix-assisted laser desorption ionization/laser desorption ionization time-of-flight mass spectrometer (MALDI/LDI TOF-MS) for analyzing at least one sample composition, said MALDI/LDI TOF-MS comprising:

a sample changer configured for receiving a sample plate upon which at least one sample to be analyzed is disposed, said sample changer and said sample plate being biased substantially at a ground voltage;

a pulsed laser source for ionizing an individual sample disposed on said sample plate within an ion source;

a repeller for motivating the ionized sample through a vacuum;

a detector for counting ions from the ionized sample as the ions collide therewith, said detector being positioned in a flight path of the ions;

a floating flight tube disposed to surround the flight path of the ions; and at least one pair of mass gate electrodes for selecting a particular ion mass in the flight path toward the detector.

2. The MALDI/LDI TOF-MS of claim 1 wherein said sample plate is configured to receive a plurality of samples disposed in a matrix configuration of at least eight samples by at least twelve samples, each of the samples being the standard size of a conventional microtiter plate.

3. The MALDI/LDI TOF-MS of claim 1 further comprising a digital camera focused on the sample to be analyzed, said digital camera generating a digital image for display on a monitor and for processing by a computer.

4. The MALDI/LDI TOF-MS of claim 3 further comprising control electronics for processing said digital image and generating signals for controlling internal functions of said MALDI/LDI TOF-MS and conventional external instruments associated with said MALDI/LDI TOF-MS including instruments provided for preparation and handling of the samples.

5. The MALDI/LDI TOF-MS of claim 4 wherein said control electronics further generates feedback control of said MALDI/LDI TOF-MS and the conventional external instruments, said feedback control being generated based on analysis by said control electronics of sample image, mass spectra collected through analysis of a sample, and other available data generated by said MALDI/LDI TOFMS and the conventional external instruments.

6. The MALDI/LDI TOF-MS of claim 1 further comprising a work shelf defining a sample entry opening for receiving said sample plate, said sample entry opening being disposed to cooperate with a sample entry chamber defined by said sample changer.

7. The MALDI/LDI TOF-MS of claim 6 further comprising an illumination device disposed above said work shelf for illuminating said sample entry opening.

8. The MALDI/LDI TOF-MS of claim 1 wherein said ion source employs a gridless second-order spatial focusing condition.

9. A matrix-assisted laser desorption ionization/laser desorption ionization time-of-flight mass spectrometer (MALDI/LDI TOF-MS) for analyzing at least one sample composition, said MALDI/LDI TOF-MS comprising:

a sample changer configured for receiving a sample plate upon which at least one sample to be analyzed is disposed, said sample changer and said sample plate being at a ground voltage, said sample plate being configured to receive a plurality of samples disposed in a microtiter plate matrix configuration of at least eight samples by at least twelve samples;

a pulsed laser source for ionizing an individual sample disposed on said sample plate within an ion source;

a repeller for motivating the ionized sample through a vacuum;

a detector for counting ions from the ionized sample as the ions collide therewith, said detector being positioned in a flight path of the ions;

a floating flight tube disposed to surround the flight path of the ions;

at least one pair of mass gate electrodes for selecting a particular ion mass in the flight path toward the detector; and a digital camera focused on the sample to be analyzed, said digital camera generating a digital image for display on a monitor and for processing by a computer.

10. The MALDI/LDI TOF-MS of claim 9 further comprising control electronics for processing said digital image and generating signals for controlling internal functions of said MALDI/LDI TOF-MS and conventional external instruments associated with said MALDI/LDI TOF-MS including instruments provided for preparation and handling of the samples.

11. The MALDI/LDI TOF-MS of claim 10 wherein said control electronics further generates feedback control of said MALDI/LDI TOF-MS and the conventional external instruments, said feedback control being generated based on analysis by said control electronics of sample image, mass spectra collected through analysis of a sample, and other available data generated by said MALDI/LDI TOF-MS and the conventional external instruments.

12. The MALDI/LDI TOF-MS of claim 9 further comprising a work shelf defining a sample entry opening for receiving said sample plate, said sample entry opening being disposed to cooperate with a sample entry chamber defined by said sample changer.

13. The MALDI/LDI TOF-MS of claim 12 further comprising an illumination device disposed above said work shelf for illuminating said sample entry opening.

14. The MALDI/LDI TOF-MS of claim 9 wherein said ion source employs a gridless second-order spatial focusing condition.

15. A matrix-assisted laser desorption ionization/laser desorption ionization time-of-flight mass spectrometer (MALDI/LDI TOF-MS) for analyzing at least one sample composition, said MALDI/LDI TOF-MS comprising:

a sample changer configured for receiving a sample plate upon which at least one sample to be analyzed is disposed, said sample changer and said sample plate being biased substantially at a ground voltage, said sample plate being configured to receive a plurality of samples disposed in a matrix configuration of at least eight samples by at least twelve samples;

a pulsed laser source for ionizing an individual sample disposed on said sample plate within an ion source, said ion source employing a gridless second-order spatial focusing condition;

a repeller for motivating the ionized sample through a vacuum;

a detector for counting ions from the ionized sample as the ions collide therewith, said detector being positioned in a flight path of the ions;

a floating flight tube disposed to surround the flight path of the ions;

at least one pair of mass gate electrodes for selecting a particular ion mass in the flight path toward the detector;

a digital camera focused on the sample to be analyzed, said digital camera generating a digital image for display on a monitor and for processing by a computer;

control electronics for processing said digital image and generating signals for controlling internal functions of said MALDI/LDI TOF-MS and conventional external instruments associated with said MALDI/LDI TOF-MS including instruments provided for preparation and handling of the samples, thereby accomplishing, said control electronics further generating feedback control of said MALDI/LDI TOF-MS and the conventional external instruments, said feedback control being generated based on analysis by said control electronics of sample image, mass spectra collected through analysis of a sample, and other available data generated by said MALDI/LDI TOF-MS and the conventional external instruments; and a work shelf defining a sample entry opening for receiving said sample plate, said sample entry opening being disposed to cooperate with a sample entry chamber defined by said sample changer.

16. The MALDI/LDI TOF-MS of claim 15 further comprising an illumination device disposed above said work shelf for illuminating said sample entry opening.

* * * * *